United States Patent [19]

Schwarz

[11] 4,151,839

[45] May 1, 1979

[54] EXERCISE MACHINE

[76] Inventor: Peter W. Schwarz, 5386 Noveso Cir., Idaho Falls, Id. 83401

[21] Appl. No.: 772,083

[22] Filed: Feb. 25, 1977

[51] Int. Cl.[2] ..... A61H 7/00

[52] U.S. Cl. ..... 128/52; 128/25 R; 272/97

[58] Field of Search ..... 272/97, 96; 128/52, 128/25 R, 51, 53, 25 B; 35/29 R; D34/40, 42; D24/5 K; 259/91, 112, 113

[56] References Cited

U.S. PATENT DOCUMENTS

| | | | |
|---|---|---|---|
| 1,527,227 | 2/1925 | Sanders | 259/91 |
| 1,709,410 | 4/1929 | Simmons | 128/25 B |
| 2,566,484 | 9/1951 | Coury | 128/25 B |
| 2,573,808 | 11/1951 | Ravoire | 35/29 R |
| 3,711,089 | 1/1973 | Reinhard | 272/97 |
| 3,831,935 | 8/1974 | Hofle | 272/97 |
| 3,880,153 | 4/1975 | Perrine | 128/52 |
| 3,911,907 | 10/1975 | Smith | 272/146 |

*Primary Examiner*—Richard J. Johnson
*Attorney, Agent, or Firm*—Fitch, Even, Tabin & Luedeka

[57] ABSTRACT

An exercise machine especially for the legs and lower trunk of the human body includes a pair of foot supports mounted on a plate. Means connected to the plate oscillates the plate up and down in simple harmonic motion, and a pair of handles are provided above the plate at about hip level for gripping to steady a person exercising on the machine.

9 Claims, 4 Drawing Figures

Fig. 1.
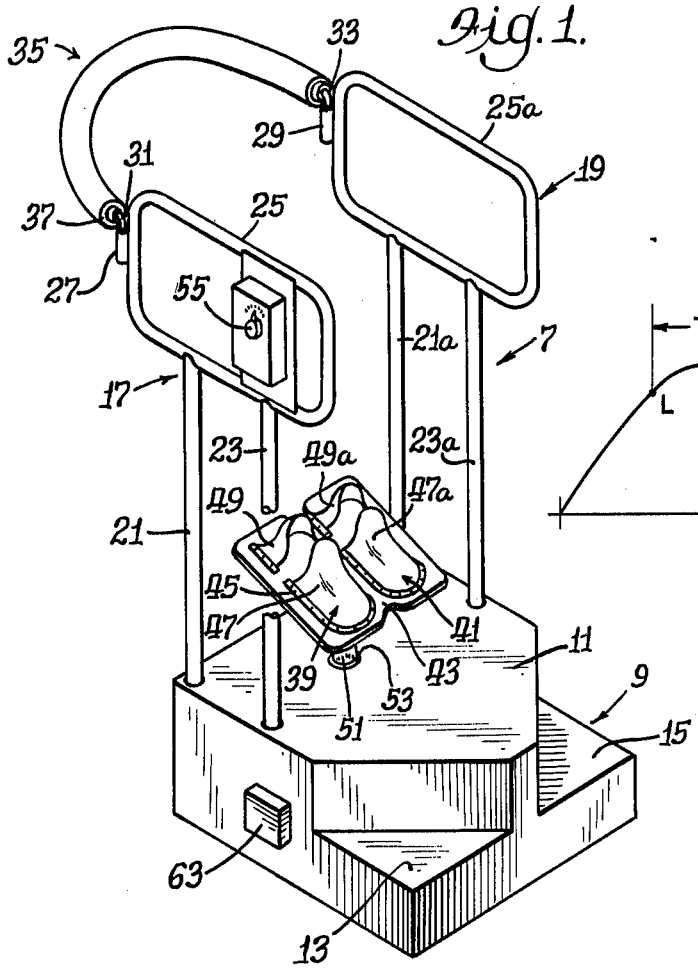
Fig. 4.
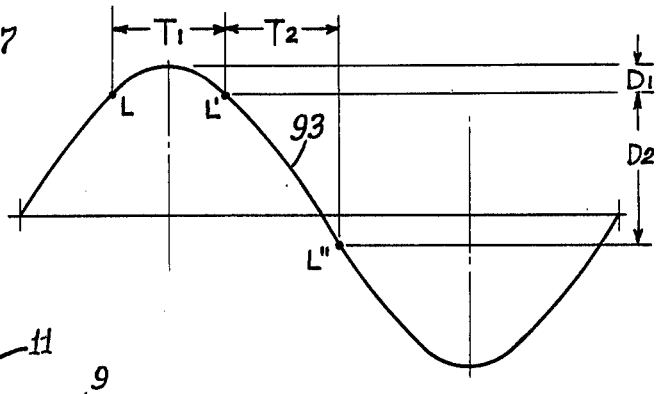
Fig. 3.
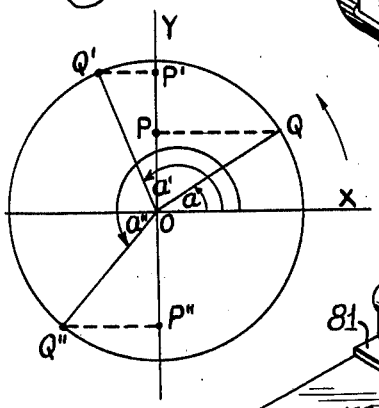
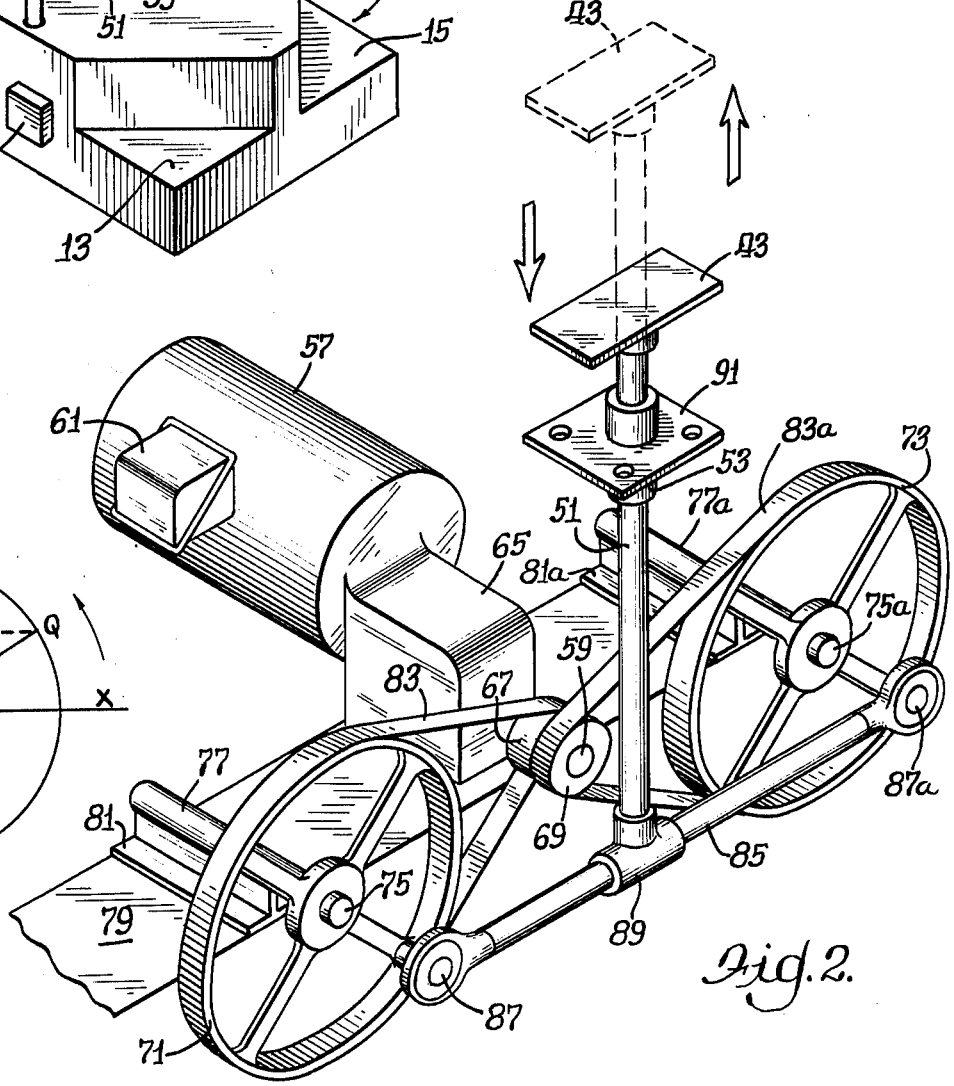
Fig. 2.

EXERCISE MACHINE

This invention relates to exercise devices and particularly to machines for exercising the legs and lower trunk of the human body.

In the training of the human body for physical conditioning, it is a familiar experience that additional stress may be placed upon the body to obtain a general increase of strength, flexibility and endurance or to improve or maintain the general tone of the musculature. Further, particular stress may be placed upon certain portions of the body to improve skill and endurance in a particular sport or activity and desirably to bring about an acuteness to the conditions encountered in the particular sport or activity. In such training, it is generally an aim to cause the cardiorespiratory system to become more efficient and to improve the range of motion of joints.

Many sports inherently are difficult to prepare for apart from on-site experiences in these sports. One such sport is downhill skiing. Aside from general physical conditioning, it is desirable to have means available that simulate the strains and rigors of downhill ski racing, because hills or mountains and snow are not always available for practice.

Accordingly, it is an object of this invention to provide an exercise machine for physical fitness conditioning and training that is adapted for use as an at-home exerciser and that simulate the strains and rigors of downhill ski racing.

This and other objects of the invention will become apparent and the invention readily understood from the following description read in connection with the accompanying drawings in which:

FIG. 1 is a perspective view of an exercise machine embodying certain features of this invention and having a portion broken away for clarity of illustration;

FIG. 2 is a perspective view of a drive portion of the machine of FIG. 1;

FIG. 3 is a graphical illustration of the relation of uniform circular motion to simple harmonic motion; and FIG. 4 is a graphical illustration of displacement in relation to time in simple harmonic motion.

Briefly, an exercise device or machine constructed in accordance with the invention is one which provides a pair of foot supports mounted on a plate to move the foot supports simultaneously. The plate is mounted to reciprocate up and down in the same path while a person is standing with both feet in the supports in the exercise position on the machine. The reciprocation is provided in a particular manner that results in the mounting plate moving in simple harmonic motion. The person positioned in the foot supports is steadied or balanced during exercising by gripping a pair of handles on either side of the machine at about hip level. This machine provides an excellent form of exercise for the loosening and the strengthening of the legs and knees. For the person exercising, the motion is especially easy at the extremes of the reciprocation because there is not a sharp or sudden change of direction. Rather, there is a soft motion during the change of direction at the top and bottom of the path traversed by the reciprocating plate.

Referring initially to FIG. 1 of the drawing, there is shown an exercise device or machine 7 having a base 9 on top of which is a platform 11. A pair of corners at a common end are partially cut away to provide steps 13 and 15 which are useful for a person in getting into an exercise position on the machine.

The base 9 is generally hollow and provides a housing for the drive mechanism that will be described herinafter. This base may be constructed of wood, molded plastic, or metal, such as steel or aluminum.

Rising out of the platform 11 along either side of the base 9 are a pair of opposed side rails 17 and 19. In the illustrated embodiment, each of these side rails includes a pair of parallel vertical columns 21, 23 and **21*a*, 23*a* supporting at their tops closed loops 25 and 25*a* respectively. The four columns are suitably anchored for support internally of the base 9. In the illustrated embodiment, the side rails 17 and 19 are of a one inch metal tube construction. Loops 25 and 25*a* are in the same planes as their corresponding pairs of vertical column supports. At the ends of the loops 25 and 25*a* above the non-step end of the base 9 are tubular holders 27 and 29 respectively. These tubular holders are secured in a conventional manner, such as by welding, to the loops. These holders 27 and 29 receive pins 31 and 33 that in turn are formed at the ends of a U-shaped back rail 35. The back rail 35 may also be of 1 inch metal tube construction, and it includes a suitable padding 37** therearound for the comfort of the person exercising.

A pair of foot supports in the form of foot bindings 39 and 41 are provided to receive the feet of the person using the exercise machine and to support that person on the machine. These foot supports are mounted on a plate 43 and secured thereto in a suitable manner, such as by appropriate lengths of a strap 45. Suitable hardware may be utilized to attach the straps to the plate with the bindings 39 and 41 sandwiched in between. These illustrated bindings are each divided into two parts, namely insteps 47, **47*a* and heels 49, 49*a*** and are similar to those often found on water skis. Preferably, the bindings are made of an elastic material, such as rubber. They serve the purpose of securely holding the feet in position during the exercise activity while affording an easy insertion and withdrawal of the feet of the person mounting and dismounting the exercise machine. Other foot bindings may also be utilized for this purpose, and there is no intention of limiting the invention to these illustrated bindings.

The plate 43 is mounted for support and movement on the upper end of a vertical shaft 51 that extends through, and is slidably mounted in, a bushing 53 that in turn extends through an opening in the platform 11. This shaft 51 is located so as to position the plate 43 centrally within the space bounded by the side rails 17 and 19. This whole combination is located generally toward the rear of the base 9, the front of the base 9 being, for purposes of this description, the end toward which the toes of the bindings 39 and 41 are directed. Thus, a person mounts the exercise machine by stepping up on the steps 13 and 15 and to the platform 11, turning around and at the same time reaching rearwardly to grasp the loops 25 and **25*a* at a convenient location, and then stepping up and backwards one step and inserting one foot at a time in the bindings 39 and 41**.

An on-off control 55 is mounted toward the front of the loop 25 in a convenient location near the right hand of the person exercising. When the machine is turned on, the plate 43 begins an up and down reciprocation in the same path along the axis of the vertical shaft 51.

Drive apparatus that causes the reciprocation of the plate 43 is illustrated in FIG. 2. All of this apparatus is mounted inside the base 9 under the platform 11. Briefly, in this illustrated embodiment the drive apparatus includes a variable speed electric drive motor that drives two gear belt sheaves through timing belts. A horizontal shaft couples the rotating sheaves. A ball bushing is slidably mounted on the horizontal shaft and couples thereto a vertical shaft, and this combination transfers the circular motion of the sheaves to a vertical reciprocating motion of the vertical shaft in a succession of strokes that reciprocates a person standing in the bindings.

More specifically, an electric motor 57, which in a working example of the illustrated embodiment is a 1 horsepower motor, is mounted in a conventional manner and contains a power output shaft 59. An electrical connection box 61 is provided on the motor for connecting it to a power source. In the illustrated instance, connection lines (not shown) join the electrical connection box 61 on the motor and a further electrical connection box 63 (FIG. 1) located on a sidewall of the base 9. This box 63 in turn is connected to a suitable power source (not shown). Although none of the wiring and circuitry for the machine is shown, it will be understood that such is provided in accordance with conventional electrical engineering practice and local codes.

The motor 57 may be a single-phase or a three-phase motor as appropriate, but preferably it is a gear motor having a gear speed reduction box 65 on the power output of the motor. A pair of driving sheaves 67 and 69 are mounted in parallel on the power output shaft 59. A pair of driven sheaves 71 and 73 are mounted for rotation on either side of the motor 57. The driven sheaves 71 and 73 are mounted on shafts 75 and 75*a*, respectively, which are rotatably contained in shaft support sleeves 77 and 77*a*. These in turn are secured to opposite ends of a mounting surface 79 by means of shaft support bracket 81 and 81*a* respectively. The mounting surface may be either the floor of the base 9 or a suitable inside liner provided for the purpose.

The motor 57 may also be anchored to this mounting surface 79. Suitable thrust devices (not shown) are provided to properly hold the shafts 75, 75*a* in their respective sleeves 77, 77*a* to axially retain the shafts while allowing free rotation thereof in the sleeves.

The driving sheave 67 is rotatively coupled to the driven sheave 71 and the driving sheave 69 is rotatively coupled to the driven sheave 73 by means of timing belts 83 and 83*a* respectively. All sheaves are appropriately grooved for receiving the timing belts. Preferably, the driving sheaves 67 and 69 are of smaller diameter than the respectively related driven sheaves 71 and 73 to effect a stepdown in the rotative speed ratio between the motor output shaft 59 and the driven shafts 75, 75*a*. Thus arranged, the motor 57 drives the sheaves 71 and 73. A drive shaft in the form of a connecting rod 85 is connected at its ends for pivotal movement to the driven sheaves 71 and 73 by pivot pins 87, 87*a* respectively. Initially, the driven sheaves 71 and 73 are moved so that the pivot pins 87 are in the same relative rotative position on each of the driven sheaves. This effects parallel radii for the disposition of the mounting pins 87, 87*a* which are then disposed at equidistantly located points along the radii from the axes of rotation of the shafts 75 and 75*a* respectively. The length of the radii is preselected in accordance with the desired almplitude of reciprocation. For this purpose, several holes (not shown) may be provided in predetermined locations along a spoke of each of the sheaves 71 and 73 and the pins 87, 87*a* being adjustably positioned in the holes. The connecting rod 85 thus assumes a horizontal orientation. The time belts 83 are then applied. The unison movement of the sheaves 71 and 73 thereafter maintains the horizontal orientation of the connecting rod 85 as its ends pivot on the pivot pins 87, 87*a*. During rotation of the driven sheaves 71 and 73, the connecting rod 85 moves in a horizontal path while simultaneously the level of rod 85 is raised and lowered. A T-shaped bushing 89 is employed to allow the horizontal movement of the connecting rod 85 while translating the change in elevation of the rod into vertical strokes. Preferably, the longitudinal opening of the bushing 89 contains a suitable antifriction bearing, and the bushing 89 is mounted on the connecting rod 85 so that the rod moves freely through the horizontal opening of the bushing 89. The antifriction bearing allows the connecting rod 85 to slide back and forth through the longitudinal opening of the bushing with minimal losses.

The trunk of the T-shaped bushing 89 is utilized to mount the lower end of the vertical shaft 51, the other end of which extends up through the platform 11 (FIG. 1) and connects to the plate 43. Intervening is the bushing 53 which is secured to the underside of the platform 11 by means of a mounting plate 91. Preferably, the bushing 53 also includes an antrifriction bearing to afford substantially friction-free movement of the shaft 51 therethrough. The plate 91 prevents any lateral movement of the shaft 51 while permitting its vertical movement. This locks the path of movement of the shaft 51 so that the plate 43 moves up and down in the same path along the axis of the shaft 51.

As already mentioned, the extremes of the path traversed by the plate 43, i.e., the amplitude of reciprocation of the plate, are determined by the radial distances from the shafts 75, 75*a* to the pivot pins 87 and 87*a* respectively. In this connection, these distances on both the driven sheaves 71 and 73 must be equal. Preferably, the amplitude of reciprocation is predetermined to be within a range of from 6 inches to 12 inches.

Although the gear box 65 and the difference of sheave diameters effects a reduction in the output revolutions per minute of the motor 57 to a predetermined reciprocation frequency that may be tolerable to the person exercising on the machine, it is further desirable to provide means for varying this reciprocation frequency. Accordingly, in the illustrated embodiment a conventional speed control is provided for the motor 57. Such speed control could be, for example, a silicon controlled rectifier (SCR) circuit adapted to operate with the motor 57 to effect a range in reciprocating frequency of the plate 43. Preferably, this range in frequency is from about one-quarter cycle per second to about three cycles per second. Moreover, the speed control of the motor 57 preferably is integrated with the on-off control 55 (FIG. 1). This permits the person exercising on the machine to set the initial reciprocation rate and/or to change the rate while exercising at the control 55 conveniently located at the person's right hand.

The kind of movement this illustrated arrangement produces on the plate 43 is significant. Except during a speed change, the pivot pins 87 and 87*a* move in uniform circular motion. The illustrated combination of elements translates this uniform circular motion of the pins 87 and 87*a* into a simple harmonic motion of the plate 43. For this purpose and with reference to FIG. 3, simple harmonic motion is described in connection with a series of arbitrarily selected positions of a point traveling a circumference in uniform circular motion, the positions being projected to the vertical diameter of that circumference. Thus, the graph illustrates the X and Y axes and a circular path of the point Q. As a point at position Q moves to Q' and Q'', the projections of these respective positions are taken on the Y axis and are indicated respectively as P, P' and P''. The path determined by the projections P along the Y axis corresponds to the path through which the plate 43 moves as the driven sheaves 71 and 73 rotate.

It can be shown that the plotting of a point in uniform circular motion as a function of time results in a sinusoid (sine wave). Such is shown in FIG. 4 wherein is represented the displacement of the plate 43. Specifically, three locations of the plate are considered, and these locations are separated by two equal time periods T1 and T2. The time period T1 is taken as the plate 43 approaches the upper extreme and reverses direction. The point L represents the location of the plate 43 at the beginning of T1 and the point L' represents the location of the plate 43 at the conclusion of T1 after the plate has reversed its direction and has started its downward movement. During the time period T1, the vertical distance traversed by the plate 43 is represented by D1. Immediately succeeding time period T1 is time period T2, which is of equal duration to T1. During T2 the vertical distance traversed by the plate 43 is represented by D2. It can be seen that the increments of movement for a given time period are relatively small when the movement is near the peak of the amplitude. Conversely, the increments of movement for a like time period are relatively large when the movement is intermediate the peaks of the amplitude.

Such motion of the plate 43 provide a "soft" change of direction for the person exercising.

It is appreciated that other forms of drives may be utilized to produce this simple harmonic motion in the plate 43. For example, it is conceivable that a single rotating fly wheel having a rod connected to it that reciprocates a piston might be utilized. However, simplicity, cost, and durability are all important considerations in the exercise machine, and it is believed that the force system of the illustrated embodiment is preferably for all of these purposes to that of other forms of drives.

In using the illustrated machine for exercising, a relaxed floating position for the trunk of the body is assumed by the person exercising while the legs and hips are in a constant flexing motion. The hip flexion and knee flexion, i.e., the extent of function permitted by the muscles and surrounding tissues at these movable joints, are particularly important for the sport of skiing, and the movement provided by this machine enhances the flexibility of the hips and knees. At the same time, the person exercising may sway to either side, to the rear, and to the front during exercising to physically work the body as desirable for conditioning. Furthermore, this machine may be utilized as an aid to the treatment of the sick or injured as a form of physiotherapy. Such may be used in restoring the function of wated, stiff or contracted muscles after injuries, especially fractures of bones, or after paralysis. The adjustable reciprocation frequency enables the person to physically exercise at a rate suitable to a particular need. It is apparent that the cardiorespiratory system will become more efficient and that the range of motion of the joints of the lower body will be improved. Such exercise, of course, is beneficial to the so-called hamstring muscles, the quadraceps, and the other muscles associated with the legs.

Summarizing, there has been described an exercise machine especially for the legs and lower trunk of the human body that includes a pair of foot supports 39 and 41, a plate 43 mounting these foot supports and for simultaneously moving them, and a vertical shaft 51 connected to the plate and driven by a variable speed electric drive motor 57, a pair of driving sheaves 67 and 69, a pair of timing belts 83 and **83*a*, a pair of driven sheaves 71 and 73, and a drive shaft or connecting rod 85 through an antifriction bushing 89 to reciprocates the plate in an up and down motion in the same path along the axis of the shaft 51 in a simple harmonic motion. A pair of opposing side rails 17 and 19** are provided on either side of the machine for a person to grip in balancing the body when positioned on the plate with the feet in the foot supports during the reciprocation of the supports.

Such a machine is useful for an at-home exerciser in simulating downhill ski conditions as well as toning the musculature, improving the efficiency of the cardiorespiratory system, and increasing the range of motion of bone joints. It is also useful in physiotherapy.

While the invention has been described in connection with a preferred embodiment, alternatives, modifications, and variations may be apparent to those skilled in the art in view of the foregoing description. Accordingly, it is intended to embrace all such alternatives, modifications, and variations as fall within the spirit and scope of the appended claims.

What is claimed is:

1. An exercise machine especially for the legs and lower trunk of the human body, comprising: a plate; a pair of foot supports mounted on said plate means connected to said plate for simultaneously reciprocating said plate and said foot supports up and down in the same path along a given axis in simple harmonic motion having an amplitude of at least about 6 inches and a pair of fixed handles mounted on opposite sides of said axis above said plate at about hip level for gripping to steady a person whose feet are positioned in said foot supports on said plate when the plate is reciprocating.

2. An exercise device in accordance with claim 1 further comprising means for controlling the frequency of reciprocation of said plate.

3. An exercise device in accordance with claim 2 wherein the frequency is variable from one-quarter cycle per second to three cycles per second.

4. An exercise device in accordance with claim 1 wherein the amplitude of the reciprocation is a predetermined value and is within a range of from 6 inches to 12 inches.

5. An exercise device in accordance with claim 1 wherein said means for reciprocating includes a pair of driven sheaves spaced horizontally from each other and mounted for rotation in a plane common to both, said sheaves being rotatively coupled; a drive shaft having its ends pivotally mounted on said driven sheaves at points along parallel radii, one on each said sheave, and equidistant from the respective axes of rotation so that said shaft is horizontal when mounted and remains horizontal during rotation of the sheaves; an antifriction bushing slidably mounted on said drive shaft intermediate the end of said shaft; and a vertical shaft connected between said bushing and said plate for transmitting the vertical component of the rotative movement of said pivot points from said drive shaft to said plate.

6. An exercise device in accordance with claim 5 wherein said means for reciprocating further includes a motor; a pair of driving sheaves mounted in parallel on the output shaft of said motor, said driving sheaves being smaller in diameter than said driven sheaves; and means individually connecting said driving sheaves to said driven sheaves.

7. An exercise device in accordance with claim 6 wherein said connecting means are timing belts.

8. An exercise device in accordance with claim 6 wherein said motor is a gear motor.

9. An exercise device in accordance with claim 6 further including a speed control system for varying the speed of said motor.

* * * * *